US005682769A

United States Patent [19]

Baker

[11] Patent Number: 5,682,769

[45] Date of Patent: Nov. 4, 1997

[54] SETTING FOR A DECORATIVE ARTICLE

[75] Inventor: Keith Baker, Harrisburg, Pa.

[73] Assignee: Keith Baker & Co., Harrisburg, Pa.

[21] Appl. No.: 684,828

[22] Filed: Jul. 22, 1996

[51] Int. Cl.[6] ..... A44C 17/02

[52] U.S. Cl. ..... 63/29.1; 63/26

[58] Field of Search ..... 63/26, 29.1, 31, 63/15, 19, 32, 21, 23

[56] References Cited

U.S. PATENT DOCUMENTS

| | | | |
|---|---|---|---|
| 606,621 | 6/1898 | Christl . | |
| 1,286,691 | 12/1918 | McKellar . | |
| 1,362,384 | 12/1920 | Benjamin et al. . | |
| 1,731,092 | 10/1929 | Birnbaum . | |
| 1,959,145 | 5/1934 | Zabriski . | |
| 2,134,586 | 10/1938 | Silver | 63/15 |
| 3,862,550 | 1/1975 | Sengenberger | 63/29 R |
| 4,488,415 | 12/1984 | Jenkins | 63/29 R |
| 4,742,696 | 5/1988 | Jenkins | 63/15 |
| 5,339,655 | 8/1994 | Grando | 63/26 X |
| 5,375,434 | 12/1994 | Wertheimer et al. | 63/29.1 |

*Primary Examiner*—Kien T. Nguyen
*Attorney, Agent, or Firm*—James M. Trygg

[57] ABSTRACT

A setting (10) is disclosed for removably receiving decorative articles such as gemstones (12) and pictures. The setting includes a lower member (15) and an upper member (13), each having left and right side segments (20, 22, 26, 28) that are hingedly attached by left and right pivot pins (24, 30). The side segments (20, 26) of the lower member (15) define a plane (18) along which the gemstone (12) is free to slide when inserting into and removing from the setting (10). The upper member (13) of the setting can be pivoted from a closed position where stop surfaces (54, 56) intersect the plane (18) and hold the gemstone (12) captive within the setting to an open position where the stop surfaces (54, 56) are well away from the plane (18), thereby permitting the removal of the gemstone (12).

20 Claims, 4 Drawing Sheets

SETTING FOR A DECORATIVE ARTICLE

The present invention relates to settings for removably receiving decorative articles such as gemstones and pictures, and more particularly to a hinged two part setting that opens to remove and receive the article and closes to hold the article captive within the setting.

BACKGROUND OF THE INVENTION

There is a need in the industry for certain jewelry and similar objects of personal adornment to be constructed so that the gemstone or other decorative article contained in the setting of the jewelry can be easily removed from the setting by the wearer and another substituted. This may be desirable to change the color or texture of the article displayed in the setting to coordinate with clothing or other articles being worn. In the manufacture of jewelry, it is customary to cut gemstones and other decorative articles in standard configurations, such as round, oval, square, rectangular, and marquise, and in a variety of sizes. This practice permits the use of mountings or settings that are of a standard shape and size throughout the industry. Typically, the gemstone is set in the base mounting in a relatively permanent manner by clenching fixed prongs or rolling over a soft bezel along the peripheral edge of the gemstone, or by cementing the gemstone to the base. Gemstones and decorative articles mounted in this way cannot easily be removed from the setting and another substituted in its place without causing cumulative damage to the setting and the gemstone or article. Further, such a substitution requires the services of a jeweler or lapidarian that is skilled in the art. Attempts to provide settings that allow for interchanging the decorative article frequently utilize a panel frame pivotally attached along one side of the setting so that the panel frame can be pivoted away from the main portion of the setting, the article inserted into a cavity or nest and the panel frame again hinged to its closed position and latched in place. Such a structure is disclosed in U.S. Pat. No. 4,742,696 which issued May 10, 1988 to Jenkins. The '696 patent discloses a ring having an oval shaped setting for receiving an oval gemstone. A panel frame is hingedly attached to one side of the setting and includes a latch on a side of the panel frame opposite the hinge, for latchingly engaging an edge of the setting. The panel frame engages the peripheral edges of the gemstone and holds it within the setting. The gemstone can be easily replaced by simply prying the latch open so that the panel frame pivots about its hinge to the open position. This structure has the disadvantage that the latch may be inadvertently and unknowingly opened by catching on clothing or some other object and the gemstone lost or damaged by falling out of the setting. A similar structure is disclosed in U.S. Pat. No. 1,959,145 which issued May 15, 1934 to Zabriski for holding a gemstone in a ring, a pendent, and a stickpin. In all of these cases the problem of the latch being inadvertently opened is present. Further, the actual hinges and panel frames used in these disclosures are very light and delicate so that they are easily damaged by rough handling when being opened and while in their open positions.

What is needed is a setting for removably receiving decorative articles such as gemstones and pictures, that is easily opened to permit replacement of the decorative article yet cannot be easily inadvertently opened so that the article can fall out of the setting. Additionally, the setting should be relatively sturdy when it is opened to prevent damage due to somewhat rough handling and yet be relatively compact and look aesthetically pleasing. Further, the setting should not receive cumulative damage due to frequent opening and closing in the removal and replacement of the article.

SUMMARY OF THE INVENTION

A setting is disclosed for removably holding a decorative article having a principal face and side edges adjacent the principal face. The setting includes a first side member and a second side member spaced from the first side member, the first and second side members generally defining a plane along which the decorative article is moved when inserted into the setting and when withdrawn from the setting. Means is provided for removably holding the decorative article between the first and second side members. The setting is arranged so that when the article is inserted thereinto the first and second side members are on opposite sides of the article. The first side member includes a lower first segment and an upper first segment hingedly attached thereto to hinge along a first pivot axis. Similarly, the second side member comprises a lower second segment and an upper second segment hingedly attached thereto to hinge along a second pivot axis. The setting is hingable about the first and second pivot axes between an open position where the article can be inserted along the plane into the setting and a closed position where the article is retained within the setting.

DESCRIPTION OF THE PREFERRED EMBODIMENT

Figure 1:
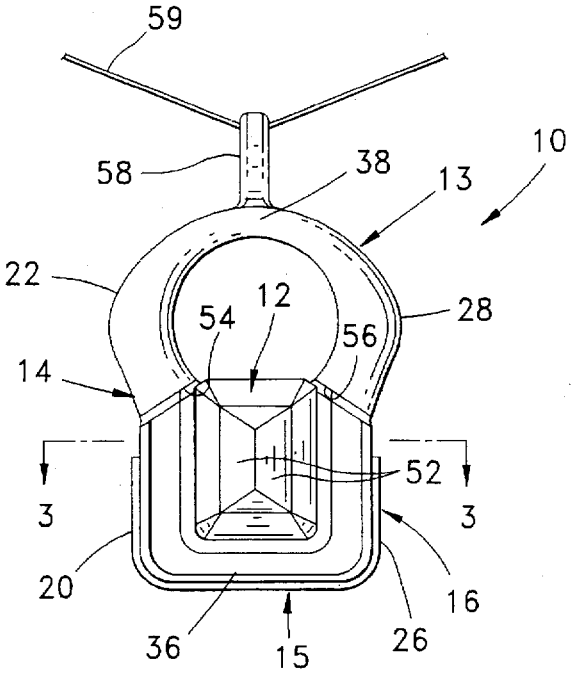
FIG. 1 is a front view of a setting incorporating the teachings of the present invention.
Figure 2:
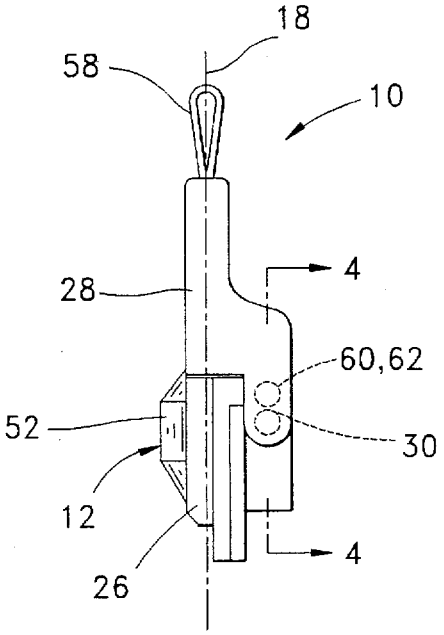
FIG. 2 is a side view of the setting shown in FIG. 1.
Figure 3:
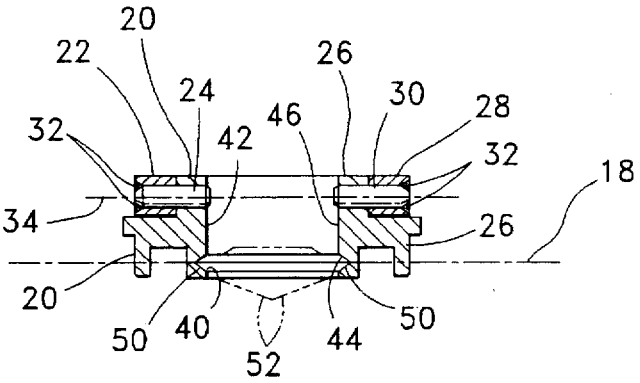
FIG. 3 is a cross-sectional view taken along the lines 3—3 in FIG. 1.

There is shown in FIGS. 1 and 2 a setting 10 having a gemstone 12 removably held in an opening therein. The setting 10 includes upper and lower members 13 and 15, respectively, as best seen in FIG. 1. The lower member 15 includes spaced apart left and right lower side segments 20 and 26 that generally define a plane 18, as shown in FIG. 2, and are rigidly interconnected through a lower bight 36. The upper member 13 includes spaced apart left and right upper side segments 22 and 28 rigidly interconnected by an upper bight 38. The left upper side segment 22 is hingedly attached to the left lower side segment 20 by means of a hinge pin 24, as shown in FIG. 3, thereby forming a hingable left side member 14. Similarly, the right upper side segment 28 is hingedly attached to the right lower segment 26 by means of a hinge pin 30, thereby forming a hingable right side member 16. The two hinge pins 24 and 30 are welded to their respective upper segments 22 and 28 as shown at 32 in FIG. 3, and extend through slip fit holes in their respective lower segments 20 and 26. The two hinge pins 24 and 30 are coaxial on a pivot axis 34 that is parallel to the plane 18. The two upper segments 22 and 28, being attached to the upper bight portion 38, form a substantially rigid but hingable upper member 13 so that the two upper segments 22 and 28 are pivotable as a rigid unit about the hinge pin axis 34 from a closed position, shown in FIGS. 1 and 2, to an open position, shown in FIGS. 5 and 6. A V-groove 40 or guideway is formed in an inner surface 42 of the left lower segment 20 and a similar V-groove 44 or guideway is formed in the opposing inner surface 46 of the right lower segment 26, as best seen in FIG. 3. The two V-grooves 40 and 44 are sized and spaced to loosely receive the outer peripheral edges 50 of the gemstone 12 and hold it between the two lower segments 20 and 26 as shown. The two V-grooves 40 and 44 are arranged substantially on or parallel to the plane 18 so that the principal face 52 of the gemstone 12 is held normal to the plane 18 as shown in FIGS. 2 and 3. Optionally, the V-grooves 40 and 44 may extend slightly into the respective upper segments 22 and 28 and into the lower bight portion 36 to accommodate longer gemstones or decorative articles of different shapes, as desired. It will be understood that the V-grooves 40 and 44 are by way of example and that grooves of other shapes may be advantageously utilized in the practice of the present invention.

Figure 6:
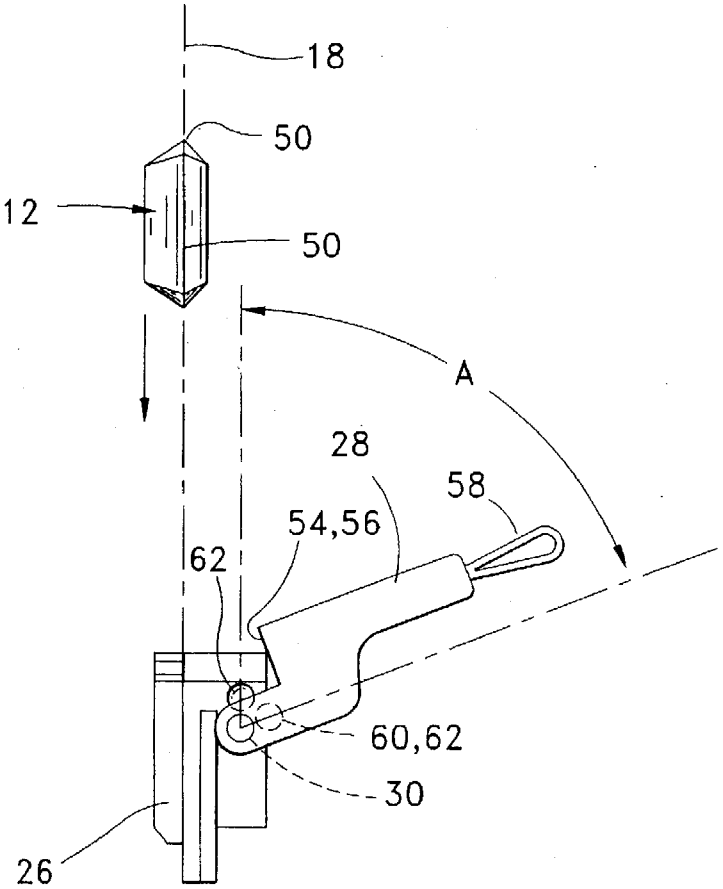
FIGS. 5 and 6 are front and side views, respectively, of the setting shown in FIG. 1 arranged in its open position.
Figure 5:
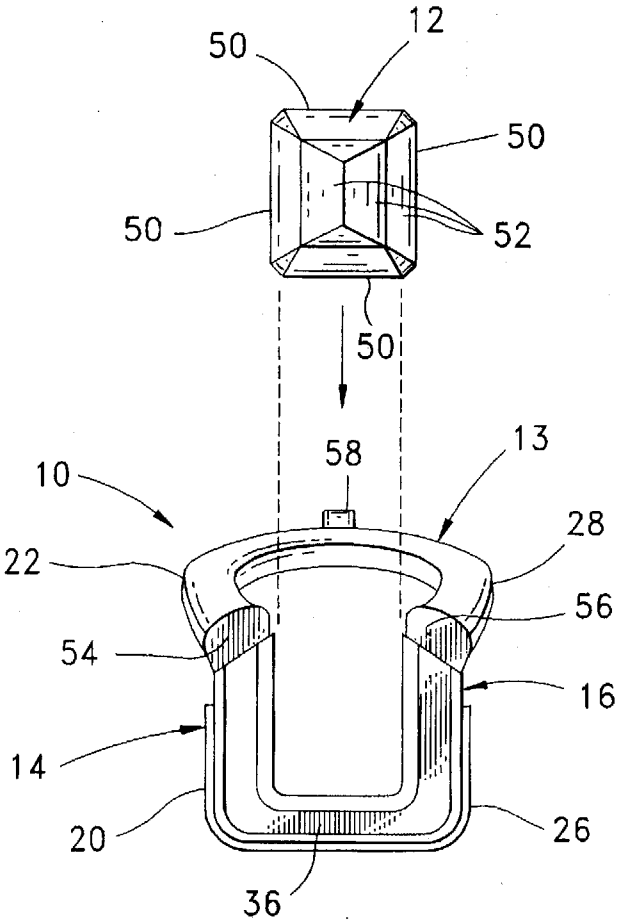

The upper left segment 22 includes a left stop surface 54 and the upper right segment 28 includes a right stop surface 56, both of which intersect the plane 18 in alignment with the V-grooves 40 and 44 when the upper member 13 is pivoted to its closed position shown in FIG. 2, thereby holding the gemstone 12 captive within the V-grooves. When the upper member 13 is pivoted to its open position, as shown in FIGS. 5 and 6, the right and left stop surfaces 54 and 56 are pivoted well away from the plane 18 so that the gemstone 12 is free to be inserted into the setting 10 by sliding along the plane 18, as shown in FIGS. 5 and 6, and causing the peripheral edges 50 to enter into the V-grooves 40 and 44 until they engage the bight portion 36. The upper member 13 is then pivoted to its closed position, as shown in FIGS. 1 and 2, so that the stop surfaces 54 and 56 intersect the plane 18 thereby capturing the gemstone in place within the setting 10. Similarly, the gemstone 12 can be removed from the setting 10 by simply pivoting the upper member 13 to its open position, shown in FIGS. 5 and 6, and sliding the gemstone outwardly along the plane 18. The pivoting of the upper member 13 from its closed position to its open position results in pivotal movement through an angle of about 20 degrees to about 80 degrees, as shown by the angle A in FIG. 6. The angle of pivotal movement need only be sufficient to move the stop surfaces 54 and 56 out of intersection with the plane 18. While the setting 10 can be made in varying forms, when it is made in the form of a pendent as shown in FIGS. 1 and 2, it includes a support hanger 58 attached to and extending from the bight portion 38. A decorative chain 59 is disposed through an opening in the hanger 58 and may extend about the neck of a wearer, in the usual manner.

Figure 4:
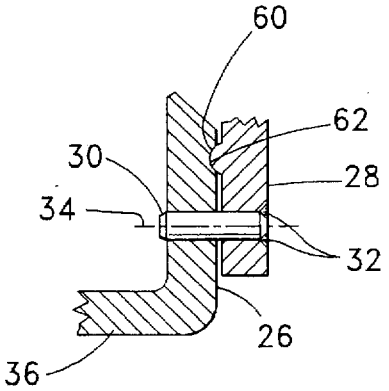
FIG. 4 is a cross-sectional view taken along the lines 4—4 in FIG. 2.

As shown in FIG. 4, a detent is provided consisting of a hemispherical projection 60 extending from the inner surface of the right upper segment 26 into a depression 62 formed in the opposing surface of the right lower segment 26. The projection 60 and depression 62 are disposed slightly above the hinge pin 30, as viewed in FIG. 4. Similarly, a projection 60 and depression 62 are formed in the left upper and lower segments 22 and 20, respectively, although not shown. When the upper member 13 is pivoted toward its open position the two projections 60 cam out of their respective depressions 62 by very slightly elastically separating the two upper segments 22 and 28 and perhaps very slightly elastically compressing together the two lower segments 20 and 26, the projections riding along the surfaces of the lower segments 20 and 26. The pivoting continues until the projections 60 reach and pass the edges of the two lower segments 20 and 26, whereupon the upper and lower segments elastically return to their respective states and the setting 10 is in its open position, as shown in FIGS. 5 and 6. This provides a definite tactile snap action when the upper member 13 is pivoted to both its open and closed positions. These left and right detents, each adjacent a respective hinge pin 32 and 30, provide sufficient force to hold the setting 10 in its close position, as shown in FIGS. 1 and 2, making it very difficult to inadvertently open the setting by snagging it on clothing or another object. Since the setting 10 must be opened by pivoting the upper member 13 out of the plane 18, when the setting 10 is hanging from the chain 59, it is very unlikely that it could be inadvertently opened.

Figure 7:
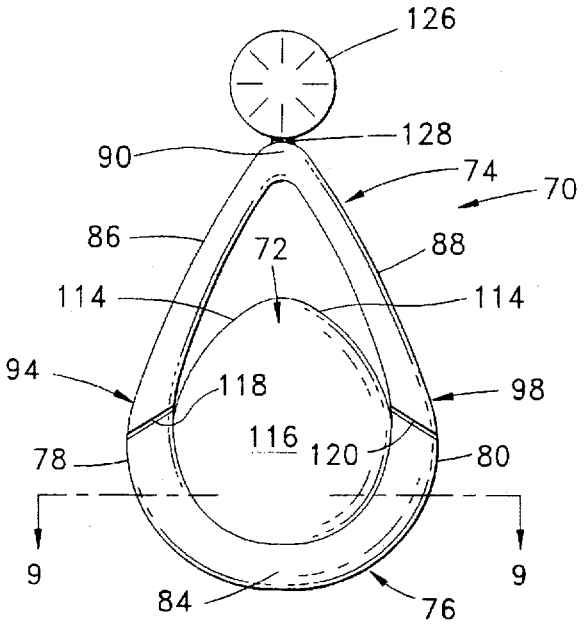
FIGS. 7 and 8 are front and side views, respectively, of a setting different from that shown in FIG. 1, incorporating the teachings of the present invention.
Figure 8:
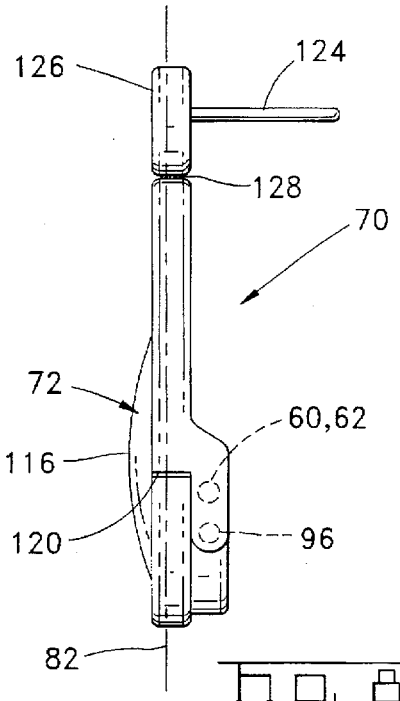
Figure 9:
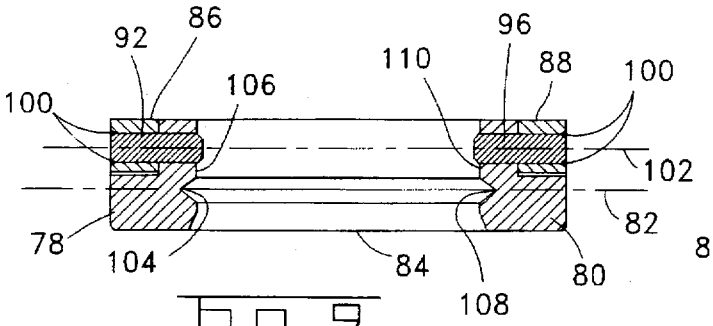
FIG. 9 is a cross-sectional view taken along the lines 9—9 in FIG. 7.

There is shown in FIGS. 7 and 8 a setting 70, in the form of an earring, having a gemstone 72 removably held in an opening therein. The setting 70 includes upper and lower members 74 and 76, respectively, as best seen in FIG. 7. The lower member 76 includes spaced apart left and right lower side segments 78 and 80 that generally define a plane 82, as shown in FIG. 8, and are rigidly interconnected through a lower bight 84. The upper member 74 includes spaced apart left and right upper side segments 86 and 88 rigidly interconnected by an upper bight 90. The left upper side segment 86 is hingedly attached to the left lower side segment 78 by means of a hinge pin 92, as shown in FIG. 9, thereby forming a hingable left side member 94. Similarly, the right upper side segment 88 is hingedly attached to the right lower segment 80 by means of a hinge pin 96, thereby forming a hingable right side member 98. The two hinge pins 92 and 96 are welded to their respective upper segments 86 and 88 as shown at 100 in FIG. 9, and extend through slip fit holes in their respective lower segments 78 and 80. The two hinge pins 92 and 96 are coaxial on a pivot axis 102 that is parallel to the plane 82. The two upper segments 86 and 88, being attached to the upper bight portion 90, form a substantially rigid but hingable upper member 74 so that the two upper segments 86 and 88 are pivotable as a rigid unit about the hinge pin axis 102 from a closed position, shown in FIG. 7 to an open position, not shown but similar to that of the setting 10 shown in FIGS. 5 and 6. A groove 104 is formed in an inner surface 106 of the left lower segment 78 and a similar groove 108 is formed in the opposing inner surface 110 of the right lower segment 80, as best seen in FIG. 7. The two grooves 104 and 108 are sized and spaced to loosely receive portions of the outer peripheral edges 114 of the gemstone 72 and hold it between the two lower segments 78 and 80 as shown. The two grooves 104 and 108 are arranged substantially on or parallel to the plane 82 so that the principal face 116 of the gemstone 72 is held normal to the plane 82 as shown in FIGS. 7 and 8. Optionally, the grooves 104 and 108 may extend slightly into the respective upper segments 86 and 88 and into the lower bight portion 84 to accommodate longer gemstones or decorative articles of different shapes, as desired.

The upper left segment 86 includes a left stop surface 118 and the upper right segment 88 includes a right stop surface 120, both of which intersect the plane 82 in alignment with the grooves 104 and 108 when the upper member 74 is pivoted to its closed position shown in FIG. 7, thereby holding the gemstone 72 captive within the grooves. Similarly, the gemstone 82 can be removed from the setting 70 by simply pivoting the upper member 74 to its open position and sliding the gemstone outwardly along the plane 82. The pivoting of the upper member 74 from its closed position to its open position results in pivotal movement through an angle of about 20 degrees to about 80 degrees, similar to the angle A for the setting 10 as shown in FIG. 6. The angle of pivotal movement need only be sufficient to move the stop surfaces 118 and 120 out of intersection with the plane 82. A stud 124 having an enlarged decorative head 126 is attached to the setting 70 by welding the head to the upper bight portion 90 as shown at 128 in FIGS. 7 and 8. The stud 124 is attached to the wearer's earlobe in the usual manner.

As shown in hidden lines in FIG. 8, a detent is provided similar to that of the setting 10 and identified by identical numbers. The detent consists of a hemispherical projection 60 extending from the inner surface of the right upper segment 88 into a depression 62 formed in the opposing surface of the right lower segment 80. The projection 60 and depression 62 are disposed slightly above the hinge pin 96, as viewed in FIG. 8. Similarly, a projection 60 and depression 62 are formed in the left upper and lower segments 86 and 88, respectively, although not shown. When the upper member 74 is pivoted toward its open position the two projections 60 cam out of their respective depressions 62 by very slightly elastically separating the two upper segments 86 and 88 and perhaps very slightly elastically compressing together the two lower segments 78 and 80, in a manner similar to the operation of the setting 10 as explained above. As with the setting 10, the two detents of the setting 70 provide a definite tactile snap action when the upper member 74 is pivoted to both its open and closed positions. These left and right detents, each adjacent a respective hinge pin 92 and 96, provide sufficient force to hold the setting 10 in its closed position, as shown in FIGS. 7 and 8, making it very difficult to inadvertently open the setting by snagging it on clothing or another object.

Figure 10:
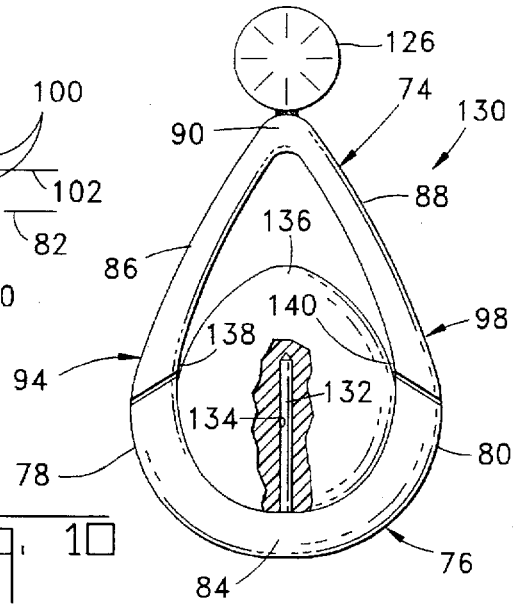
FIG. 10 shows a variation of the setting shown in FIG. 7.

There is shown in FIG. 10 an earring setting 130 that is a variation of the earring setting 70 shown in FIGS. 7 and 8. The setting 130 includes a vertically disposed post 132 extending upwardly from the lower bight portion 84 that extends into a hole 134 formed in a gemstone 136 or other decorative article. This allows holding a round or spherical gemstone or article that has no peripheral edges similar to the edges 114 of the gemstone 72. In this example, the gemstone is held captive within the setting 130 by left and right stop surfaces 138 and 140, respectively, on inner surfaces of the left and right upper segments 86 and 88. In a manner similar to that of the setting 70, the stop surfaces 138 and 140 intersect the plane 82 when the upper member 74 is in its closed position thereby holding the gemstone captive within the setting 130. In this case the grooves 104 and 108 are not used to guide or retain the gemstone 136 between the right and left lower side segments 78 and 80. Instead, the post 132 serves this purpose. Alternatively, the post 132 may be in threaded engagement with the hole 134. The stop surfaces 138 and 140 move well away from the plane 82 when the upper member 72 is pivoted to its open position so that the gemstone 136 can be removed by sliding it outwardly along the plane 82 in a direction that is parallel to the axis of the post 132. In all other respects the setting 130 is identical to the setting 70.

Figure 11:
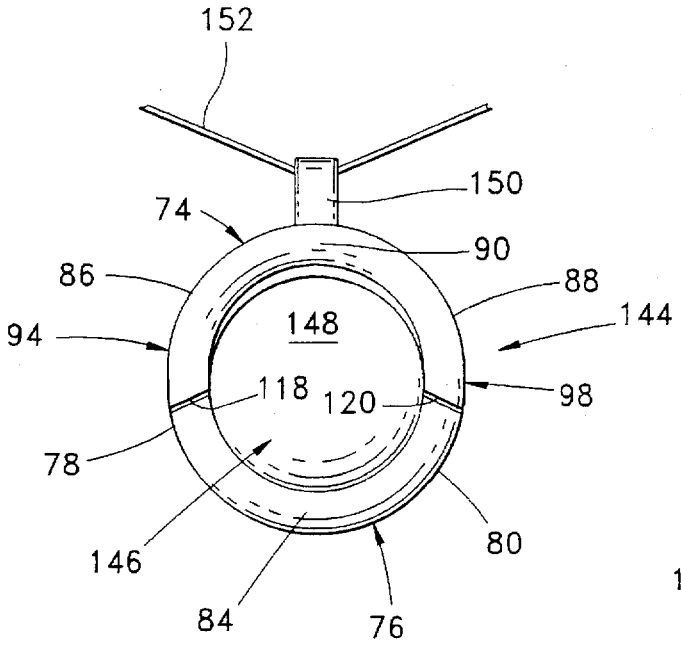
FIGS. 11 and 12 are front and side views, respectively, of a setting different from that of both FIGS. 1 and 7, incorporating the teachings of the present invention.
Figure 12:
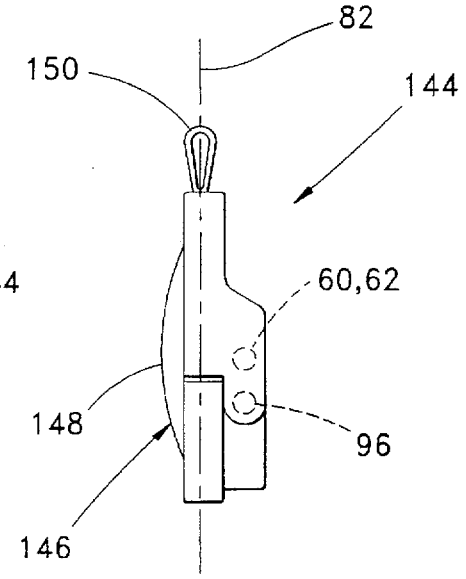

There is shown in FIGS. 11 and 12 a pendent setting 144 that is a variation of the earring setting 70 shown in FIGS. 7 and 8. The setting 144 differs from the setting 70 in shape and its use as a pendent instead of as an earring, and is intended to illustrate potential variations in structure that are deemed to be within the scope and teachings of the present invention. In all other respects the setting 144 is identical to the setting 70 having similar parts identified by similar numbers. In this case the setting 144 has a gemstone 146, or other decorative article, having a principal face 148 that is held normal to the plane 82 in a manner similar to that of the setting 70. The setting 144 includes a support hanger 150 attached to and extending from the upper bight portion 90, as shown in FIGS. 11 and 12. A decorative chain 152 is disposed through an opening in the hanger 150 and may extend about the neck of a wearer, in the usual manner. The setting 144 functionally operates in all respects in an identical manner to that of the setting 70.

An important advantage of the present invention is that the setting removably receives decorative articles such as gemstones and pictures, and is easily opened to permit replacement of the decorative article yet cannot be easily inadvertently opened so that the article can accidentally fall out of the setting and become lost or damaged. Additionally, the setting is relatively sturdy when it is opened thereby reducing damage due to somewhat rough handling and yet is relatively compact without detracting from its aesthetic appearance. Further, the setting will not receive cumulative damage due to frequent opening and closing in the removal and replacement of the decorative article.

I claim:

1. A setting for removably holding a decorative article comprising:

(a) a lower member having first and second spaced lower side segments interconnected at a lower bight portion, said first and second lower side segments generally defining a plane along which said decorative article is moved when inserted into said setting wherein said first and second lower side segments are on opposite sides of said article, and when withdrawn from said setting;

(b) an upper member having first and second spaced upper side segments interconnected at an upper bight portion; and (c) means for removably holding said decorative article between said first and second lower side segments, and for guiding said movement of said decorative article during said insertion and withdrawal, wherein said first upper side segment is hingedly attached to said first lower side segment on a first pivot axis and said second upper side segment is hingedly attached to said second lower side segment on a second pivot axis, for hinging said setting between an open position where said article can be inserted along said plane into said setting, and a closed position where said article is retained within said setting.

2. The setting according to claim 1 wherein said first and second pivot axes are arranged coaxial and parallel to said plane.

3. The setting according to claim 2 wherein said decorative article has a principal face and side edges adjacent said principal face and wherein said means for holding comprises:

(a) a first guideway in said first lower side segment for receiving some of said side edges, and (b) a second guideway in said second lower side segment for receiving others of said side edges.

4. The setting according to claim 3 wherein each of said first and second guideways is a groove formed in a respective one of said first and second lower side segments.

5. The setting according to claim 4 including a stop associated with one of said first and second upper side segments and arranged so that said stop intersects said plane when said setting is in said closed position and is away from said plane when said setting is in said open position.

6. The setting according to claim 5 wherein said stop comprises a first stop attached to said first upper side segment and a second stop attached to said second upper side segment and arranged so that when said setting is in said closed position said first stop intersects said plane adjacent said first lower side segment and said second stop intersects said plane adjacent said second lower side segment.

7. The setting according to claim 3 wherein said first guideway is formed in only said first lower side segment and said second guideway is formed in only said second lower side segment.

8. The setting according to claim 2 wherein said means for holding includes a projection extending from said setting that engages an opening in said article.

9. The setting according to claim 2 wherein said means for holding includes a post extending from said lower bight portion.

10. A setting for removably holding a decorative article having a principal face and side edges adjacent said principal face, comprising:

(a) a first side member having a first guideway;

(b) a second side member spaced from said first side member having a second guideway in opposing relationship to said first guideway, said first and second guideways generally defining a plane along which said decorative article is moved when inserting said article into said setting by causing said side edges to enter into said first and second guideways, and when withdrawing said article from said setting so that said side edges move out of said first and second guideways, wherein said first side member comprises a lower first segment and an upper first segment hingedly attached thereto to hinge along a first pivot axis and said second side member comprises a lower second segment and an upper second segment hingedly attached thereto to hinge along a second pivot axis.

11. The setting according to claim 10 wherein said first and second pivot axes are arranged coaxial and parallel to said plane.

12. The setting according to claim 10 wherein said lower first segment and said lower second segment are attached together and wherein said upper first segment and said upper second segment are attached together.

13. The setting according to claim 10 wherein each of said first and second guideways is a groove formed in a respective one of said first and second side members.

14. The setting according to claim 13 wherein said first guideway is formed in only said first lower segment and said second guideway is formed in only said second lower segment.

15. The setting according to claim 10 including a projection extending from said setting that engages an opening in said article when said article is inserted into said setting.

16. A setting for removably holding a decorative article having a principal face and side edges adjacent said principal face, comprising:

(a) a first portion having a first guideway for receiving some of said side edges, said first guideway generally defining a plane along which said decorative article is moved when inserting said article into said setting so that said side edges enter into said first guideway and when withdrawing said article from said setting so that said side edges move out of said first guideway; and (b) a second portion having at least one stop, said second portion being hingedly attached to said first portion along a hinge pivot axis for pivoting between a closed position where said stop intersects said plane and an open position where said stop is away from said plane so that, when said second portion is in said open position said article can be inserted into said setting, and when said second portion is in said closed position said stop retains said article within said setting.

17. The setting according to claim 16 wherein said hinge pivot axis is parallel to said plane.

18. The setting according to claim 16 arranged so that when said second portion is pivoted to said open position, said second portion is at an angle to said plane of between about 20 degrees and about 80 degrees.

19. The setting according to claim 16 wherein said second portion includes a second guideway for receiving other portions of some of said side edges, said first and second guideways being contiguous when said second portion is in said closed position.

20. The setting according to claim 16 wherein said first guideway includes first and second segments on opposite sides of said article and said at least one stop comprises a first stop and a second stop arranged so that when said second portion is in said closed position said first stop intersects said plane adjacent said first segment and said second stop intersects said plane adjacent said second segment.

* * * * *